US006419882B1

(12) United States Patent
Matthews

(10) Patent No.: US 6,419,882 B1
(45) Date of Patent: Jul. 16, 2002

(54) OXYGEN VENDING SYSTEM

(76) Inventor: Jeffrey Matthews, 3202 A. Richmond Ter., Staten Island, NY (US) 10303

( * ) Notice: Subject to any disclaimer, the term of this patent is extended or adjusted under 35 U.S.C. 154(b) by 0 days.

(21) Appl. No.: 09/649,878

(22) Filed: Aug. 28, 2000

(51) Int. Cl.[7] ..... A62B 7/12

(52) U.S. Cl. ..... 422/120; 235/381; 128/203; 194/241

(58) Field of Search ..... 422/120; 194/100, 194/241; 165/11; 463/29; 128/203; D20/1–9

(56) References Cited

U.S. PATENT DOCUMENTS 2,855,926 A * 10/1958 Koppelman ..... 128/203
4,167,967 A * 9/1979 Kumagai ..... 165/11
5,836,818 A * 11/1998 Jones et al. ..... 463/29
5,955,718 A * 9/1999 Levasseur et al. ..... 235/381
6,044,954 A * 4/2000 Mclaughlin ..... 194/241

FOREIGN PATENT DOCUMENTS

GB 2334805 A * 1/1999

* cited by examiner

*Primary Examiner*—Robert J. Warden, Sr.
*Assistant Examiner*—Sean E. Conley
(74) *Attorney, Agent, or Firm*—Goldstein & Lavas, P.C.

(57) ABSTRACT

An oxygen vending system including a control housing being in communication with a source of oxygen. The control housing has a timer with corresponding valve for selectively allowing a flow of oxygen through a flow restrictor. The control housing has a front face. The front face has a plurality of oxygen outputs in communication with the flow restrictor for dispensing a quantity of oxygen from the source of oxygen. A money handling housing is positioned adjacent to the control housing. The money handling housing has a money receiving slot in communication with the timer of the control housing.

5 Claims, 3 Drawing Sheets

OXYGEN VENDING SYSTEM

BACKGROUND OF THE INVENTION

The present invention relates to an oxygen vending system and more particularly pertains to dispensing a quantity of oxygen to provide a boost in energy.

The use of gas dispensing devices is known in the prior art. More specifically, gas dispensing devices heretofore devised and utilized for the purpose of dispensing gases are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,289,225 to Scholta discloses a coin operated switch and timer mechanism for dispensing compressed air for filling the tires of a motor vehicle. U.S. Pat. No. 5,620,664 to Palmer discloses a portable oxygen dispenser.

While these devices fulfill their respective, particular objective and requirements, the aforementioned patents do not describe an oxygen vending system for dispensing a quantity of oxygen to provide a boost in energy.

In this respect, the oxygen vending system according to the present invention substantially departs from the conventional concepts and designs of the prior art, and in doing so provides an apparatus primarily developed for the purpose of dispensing a quantity of oxygen to provide a boost in energy.

Therefore, it can be appreciated that there exists a continuing need for a new and improved oxygen vending system which can be used for dispensing a quantity of oxygen to provide a boost in energy. In this regard, the present invention substantially fulfills this need.

SUMMARY OF THE INVENTION

In the view of the foregoing disadvantages inherent in the known types of gas dispensing devices now present in the prior art, the present invention provides an improved oxygen vending system. As such, the general purpose of the present invention, which will be described subsequently in greater detail, is to provide a new and improved oxygen vending system which has all the advantages of the prior art and none of the disadvantages.

To attain this, the present invention essentially comprises a control housing being in communication with a source of oxygen. The control housing has a timer with corresponding valve for selectively allowing a flow of oxygen through a flow restructure. The control housing has a front face. The front face has a plurality of oxygen outputs in communication with the flow restructure for dispensing a quantity of oxygen from the source of oxygen. The front face has a selector switch corresponding with the plurality of oxygen outputs for determining which oxygen output to be used. The front face has activation and deactivation lights. A money handling housing is positioned adjacent to the control housing. The money handling housing has a money receiving slot in communication with the timer of the control housing. The money handling housing includes a function light.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved oxygen vending system which has all the advantages of the prior art gas dispensing devices and none of the disadvantages.

It is another object of the present invention to provide a new and improved oxygen vending system which may be easily and efficiently manufactured and marketed.

It is a further object of the present invention to provide a new and improved oxygen vending system which is of durable and reliable construction.

An even further object of the present invention is to provide a new and improved oxygen vending system which is susceptible of a low cost of manufacture with regard to both materials and labor, and which accordingly is then susceptible of low prices of sale to the consuming public, thereby making such an oxygen vending system economically available to the buying public.

Even still another object of the present invention is to provide a new and improved oxygen vending system for dispensing a quantity of oxygen to provide a boost in energy.

Lastly, it is an object of the present invention to provide a new and improved oxygen vending system including a control housing being in communication with a source of oxygen. The control housing has a timer with corresponding valve for selectively allowing a flow of oxygen through a flow restructure. The control housing has a front face. The front face has a plurality of oxygen outputs in communication with the flow restructure for dispensing a quantity of oxygen from the source of oxygen. A money handling housing is positioned adjacent to the control housing. The money handling housing has a money receiving slot in communication with the timer of the control housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
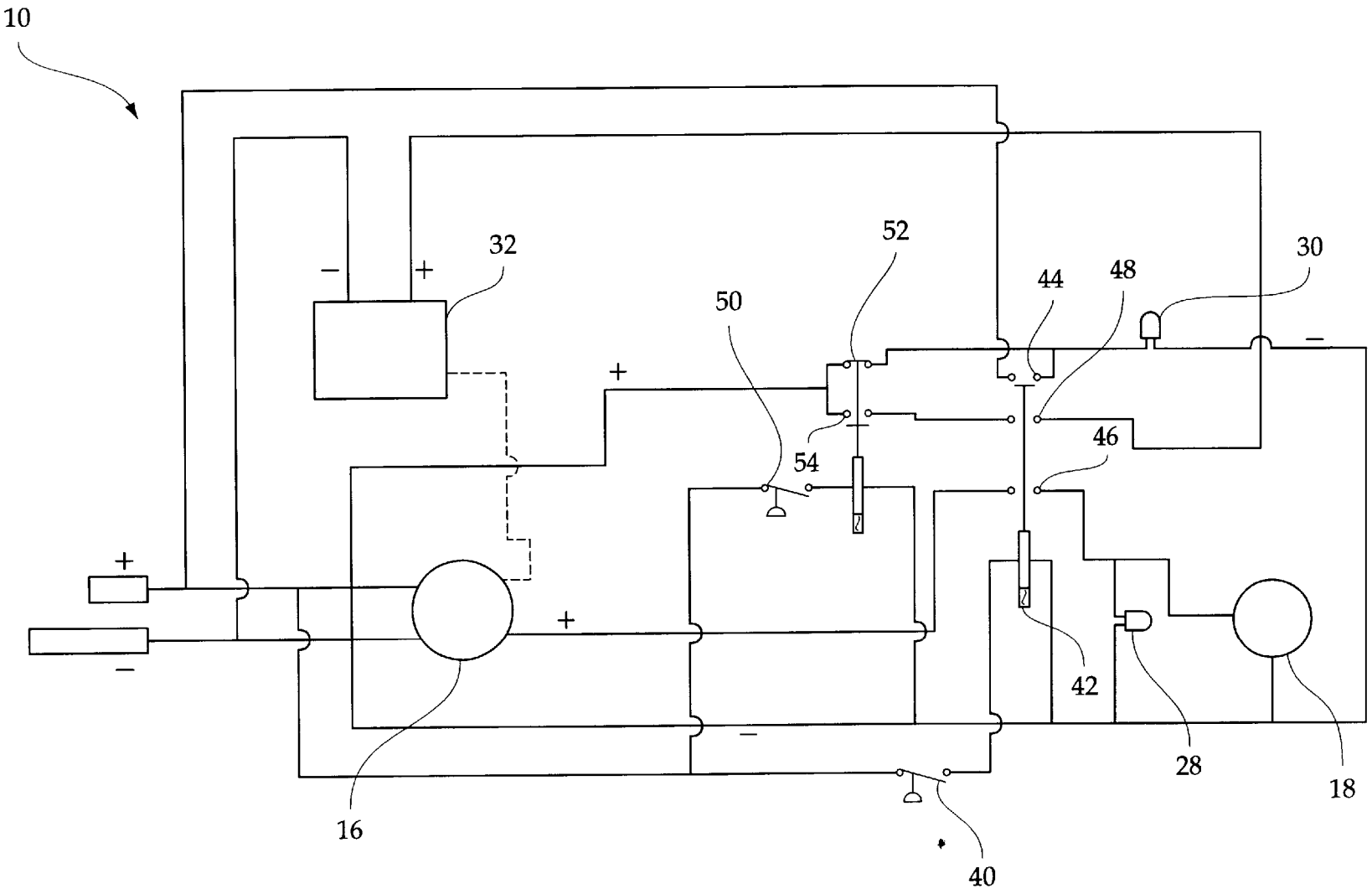
FIG. 1 is a schematic illustration of the preferred embodiment of the oxygen vending system constructed in accordance with the principles of the present invention.
Figure 2:
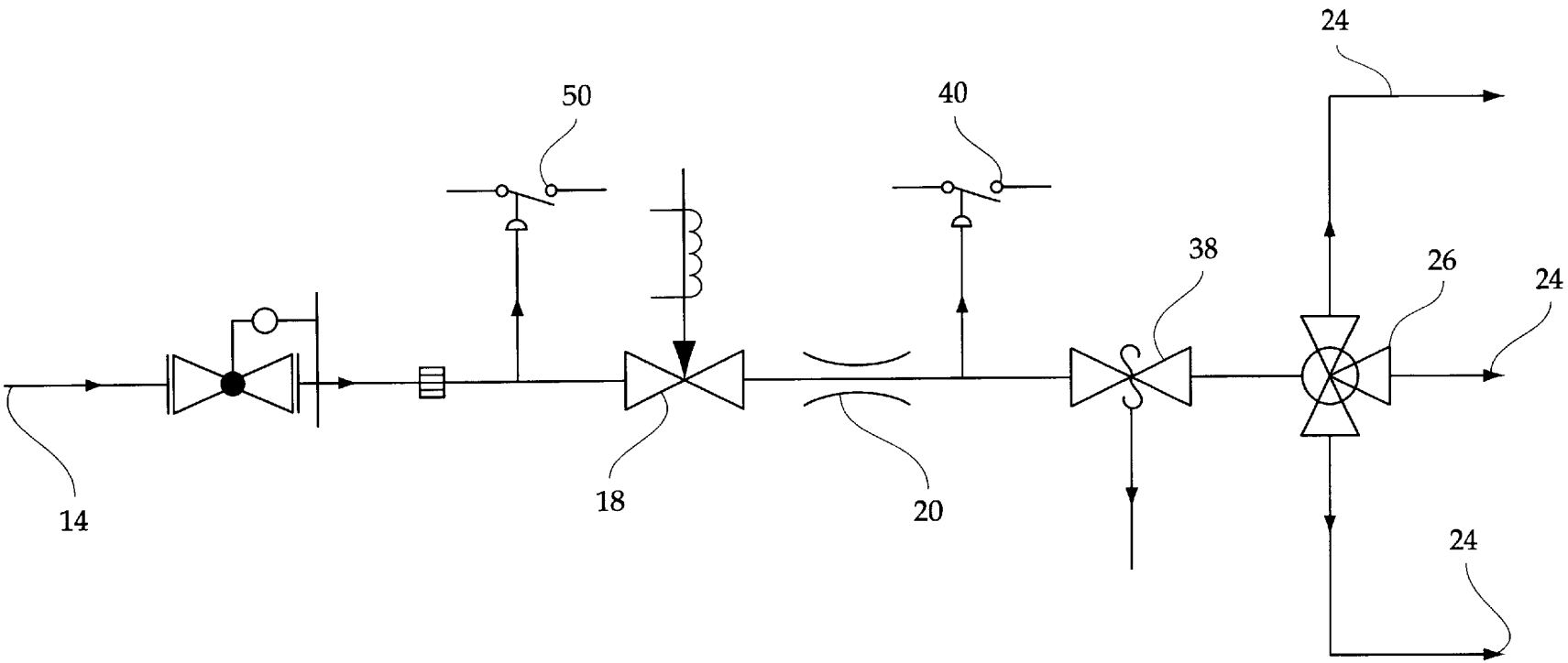
FIG. 2 is a schematic illustration of the operation of the present invention.
Figure 4:
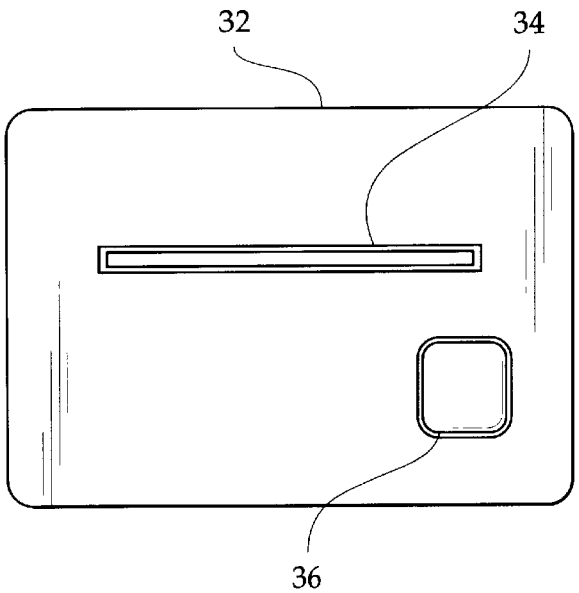
FIG. 4 is a front view of the money handling housing of the present invention.
Figure 3:
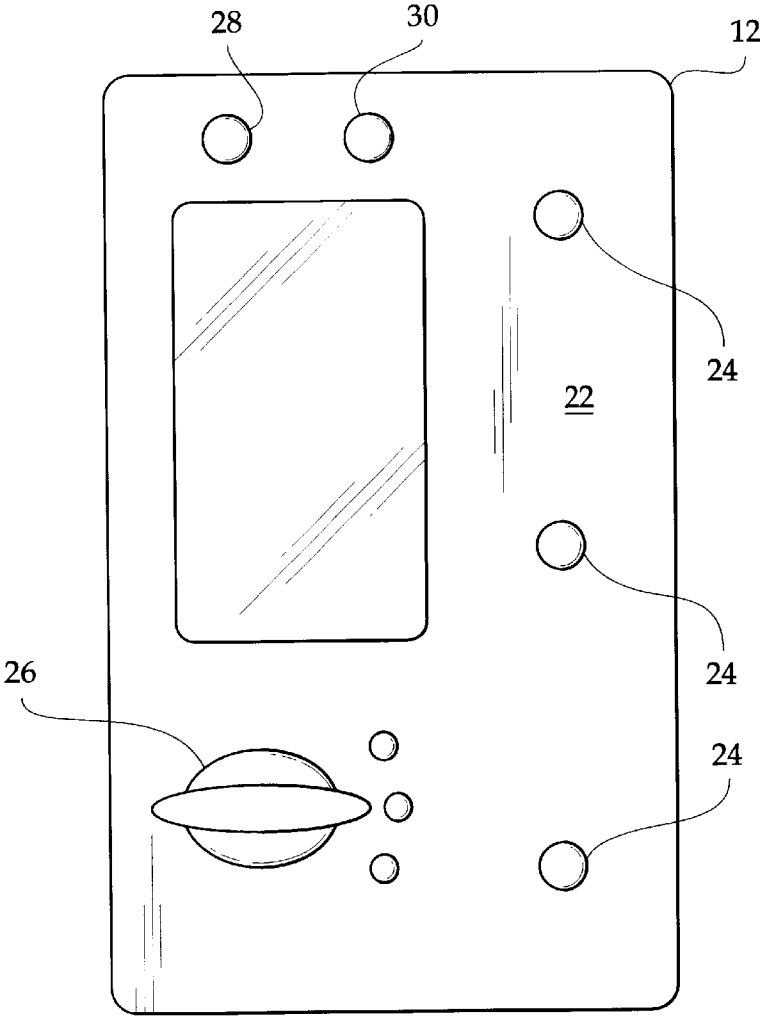
FIG. 3 is a front view of the control housing of the present invention.

With reference now to the drawings, and in particular, to FIGS. 1 through 4 thereof, the preferred embodiment of the new and improved oxygen vending system embodying the principles and concepts of the present invention and generally designated by the reference number 10 will be described.

Specifically, it will be noted in the various figures that the device relates to an oxygen vending system for dispensing a quantity of oxygen to provide a boost in energy. In its broadest context, the device consists of a control housing and a money handling housing. Such components are individually configured and correlated with respect to each other so as to attain the desired objective.

The control housing 12 is in communication with a source of oxygen 14. The source of oxygen 14 will likely be in the form of one or more tanks that can deliver the oxygen to the control housing 12. The control housing 12 has a timer 16 with corresponding valve 18 for selectively allowing a flow of oxygen through a flow restrictor 20. Activation of the timer 16 will open the valve 18 to allow the flow of oxygen through the flow restrictor 20 whereas the deactivation of the timer 16 will close the valve 18 and stop the flow of oxygen. The control housing 12 has a front face 22. The front face 22 has a plurality of oxygen outputs 24 in communication with the flow restrictor 20 for dispensing a quantity of oxygen from the source of oxygen 14. The front face 22 has a selector switch 26 corresponding with the plurality of oxygen outputs 24 for determining which oxygen output to be used. The selector switch 26 can allow user's of varying heights to select a proper output 24 for them to comfortably use. The front face 22 has activation and deactivation lights 28,30.

The money handling housing 32 is positioned adjacent to the control housing 12. The money handling housing 32 has a money receiving slot 34 in communication with the timer 16 of the control housing 12. The money handling housing 32 includes a function light 36.

The present invention operates when a customer inserts currency into the money receiving slot 34 of the money handling housing 32 which will activate the timer 16 which opens the valve 18 and the activation light 28 will light up indicating the flow of oxygen. The oxygen flows through the flow restrictor 20 to the predetermined oxygen output 24 indicated by the selector switch 26. After the timer 16 expires, the valve 18 closes ceasing the flow of oxygen to the output 24 and extinguishing the activation light 28.

If during use, the pressure should rise above a predetermined dispensing pressure, a relief valve 38 will lift preventing over-pressurization of the output 24, safely discharging the oxygen into the atmosphere. A pressure switch 40 will thereby activate closing circuit to a relay 42 which will close a first pair of contacts 44 to light the deactivation light 30 also opening a second pair of contacts 46 to the valve 18 stopping the flow of oxygen as well as opening a third set of contacts 48 opening circuit to the money handling housing 32 preventing use of the present invention and extinguishing the function light 36.

If during use, the pressure in the present invention should fall below a predetermined level, a pressure switch 50 deactivates opening circuit to relay 53 closing a fourth set of contacts 52 lighting the deactivation light 30 and opens a fifth set of contacts 54, which opens circuit to the money handling housing 32 preventing monies from being accepted and extinguishing the function light 36.

In operation, a user selects the oxygen output 24 using the selector switch 26. Money is then inserted into the money receiving slot 34. After the activation light 28 is lit, the user then cups their hand over the oxygen output 24 selected. Place their mouth over their hand and breath normally. Oxygen will continue to be dispensed as long as the activation light 28 is illuminated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An oxygen vending system for dispensing a quantity of oxygen to provide a boost in energy comprising, in combination:

a control housing being in communication with a source of oxygen, the control housing having a timer with corresponding valve for selectively allowing a flow of oxygen through a flow restrictor, the control housing having a front face, the front face having a plurality of oxygen outputs in communication with the flow restrictor for dispensing a quantity of oxygen from the source of oxygen, the front face having a selector switch corresponding with the plurality of oxygen outputs for determining which oxygen output to be used, the front face having activation and deactivation lights; and a money handling housing positioned adjacent to the control housing, the money handling housing having a money receiving slot in communication with the timer of the control housing, the money handling housing including a function light.

2. An oxygen vending system for dispensing a quantity of oxygen to provide a boost in energy comprising, in combination:

a control housing being in communication with a source of oxygen, the control housing having a timer with corresponding valve for selectively allowing a flow of oxygen through a flow restrictor, the control housing having a front face, the front face having a plurality of oxygen outputs in communication with the flow restrictor for dispensing a quantity of oxygen from the source of oxygen; and a money handling housing positioned adjacent to the control housing, the money handling housing having a money receiving slot in communication with the timer of the control housing.

3. The oxygen vending system as set forth in claim 2, wherein the front face of the control housing has a selector switch corresponding with the plurality of oxygen outputs for determining which oxygen output to be used.

4. The oxygen vending system as set forth in claim 2, wherein the front face of the control housing has activation and deactivation lights.

5. The oxygen vending system as set forth in claim 2, wherein the money handling housing includes a function light.

* * * * *